US007723591B1

(12) United States Patent
Hsiao

(10) Patent No.: US 7,723,591 B1
(45) Date of Patent: May 25, 2010

(54) WIND INSTRUMENT STAND

(75) Inventor: Huey-Hsiu Hsiao, Taipei Hsien (TW)

(73) Assignee: K.H.S. Musical Instrument Co., Ltd., Taipei Hsien (TW)

( * ) Notice: Subject to any disclaimer, the term of this patent is extended or adjusted under 35 U.S.C. 154(b) by 0 days.

(21) Appl. No.: 12/465,086

(22) Filed: May 13, 2009

(51) Int. Cl.
*G10D 7/08* (2006.01)

(52) U.S. Cl. ..... 84/385 A

(58) Field of Classification Search ..... 84/385 A, 84/385 R, 387 R; 248/443; 206/314
See application file for complete search history.

(56) References Cited

U.S. PATENT DOCUMENTS 7,414,185 B2 * 8/2008 Hsieh ..... 84/385 A

* cited by examiner

*Primary Examiner*—Kimberly R Lockett
(74) *Attorney, Agent, or Firm*—Burr & Brown

(57) ABSTRACT

A wind instrument stand has an upper pivot slide, a lower pivot bracket, multiple legs, multiple links and a post assembly. The legs are connected pivotally to the upper pivot slide. Each link is connected pivotally between the lower pivot bracket a corresponding leg. The post is mounted slidably through the upper pivot slide and securely on the lower pivot bracket. The wind instrument stand may be folded into a compact configuration and be inserted into an opening of a wind instrument to facilitate the storage and carrying of the wind instrument and stand.

9 Claims, 8 Drawing Sheets

WIND INSTRUMENT STAND

BACKGROUND OF THE INVENTION

1. Field of the Invention

The present invention relates to a stand, and more particularly to a wind instrument stand that may hold a wind instrument such as a tuba and may be changed into a compact configuration facilitating the carrying and storage of the wind instrument stand.

2. Description of Related Art

A conventional stand for wind instruments comprises a base, three legs and a supporting rod. The legs are mounted pivotally on the base. The supporting rod is mounted on the base. When a wind instrument is set on the stand, the supporting rod extends into an opening of the wind instrument.

However, the a musical instrument box does not have additional space to receive the stand so that the stand and the wind instrument would be stored or carried separately, which is inconvenient. Furthermore, the stand cannot be folded into a compact configuration, which disadvantages the storage and carrying of the stand.

To overcome the shortcomings, the present invention provides a wind instrument stand to mitigate or obviate the aforementioned problems.

SUMMARY OF THE INVENTION

The main objective of the invention is to provide a wind instrument stand that may hold a wind instrument such as a tuba and may be changed into a compact configuration facilitating the carrying and storage of the wind instrument stand.

A wind instrument stand has an upper pivot slide, a lower pivot bracket, multiple legs, multiple links and a post assembly. The legs are connected pivotally to the upper pivot slide. Each link is connected pivotally between the lower pivot bracket a corresponding leg. The post is mounted slidably through the upper pivot slide and securely on the lower pivot bracket. The wind instrument stand may be folded into a compact configuration and be inserted into an opening of a wind instrument to facilitate the storage and carrying of the wind instrument and stand.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
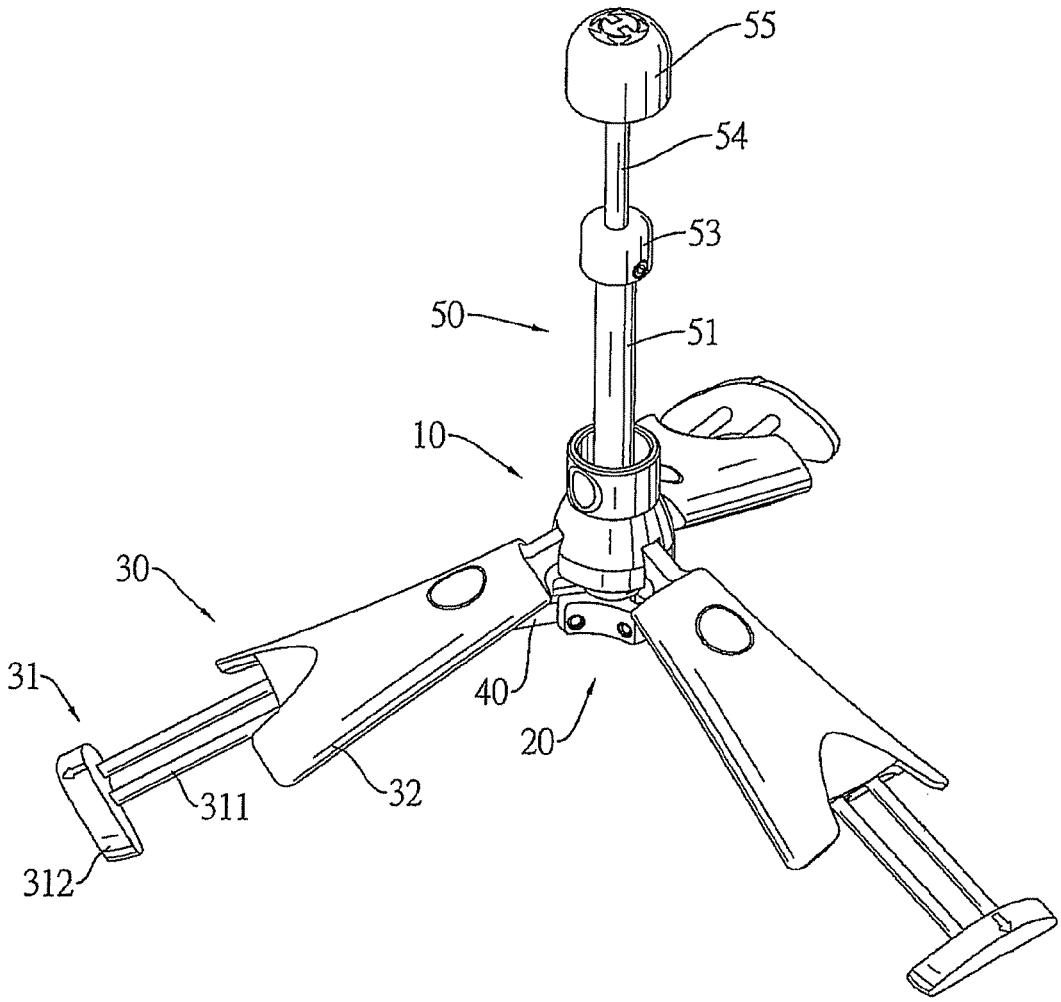
FIG. 1 is a perspective view of a wind instrument stand in accordance with the present invention in an expanding configuration.
Figure 2:
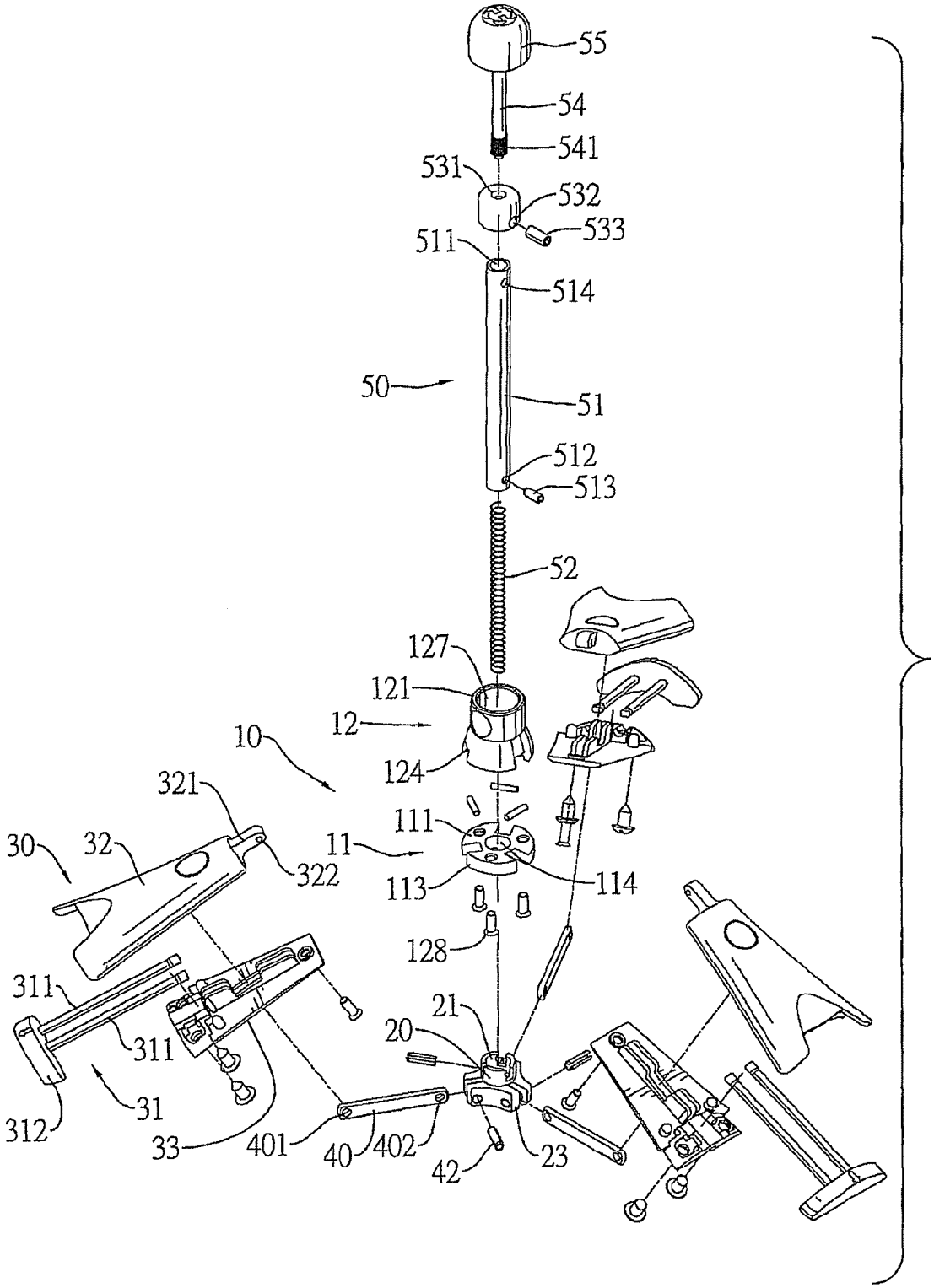
FIG. 2 is an exploded perspective view of the wind instrument stand in FIG. 1.
Figure 3:
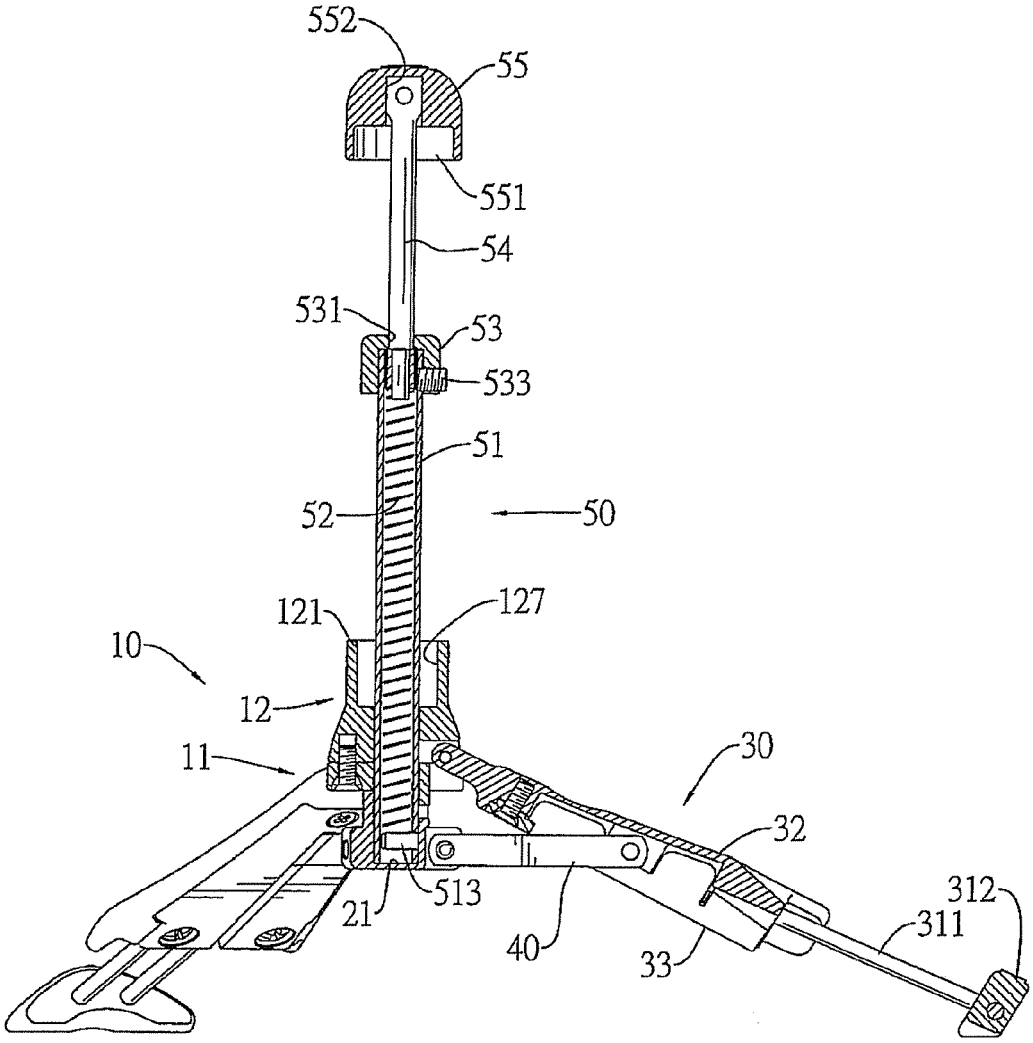
FIG. 3 is a side view in partial section of the wind instrument stand in FIG. 1.

With reference to FIGS. 1 to 3, a wind instrument stand in accordance with the present invention comprises an upper pivot slide (10), a lower pivot bracket (20), multiple legs (30), multiple links (40) and a post assembly (50).

Figure 4:
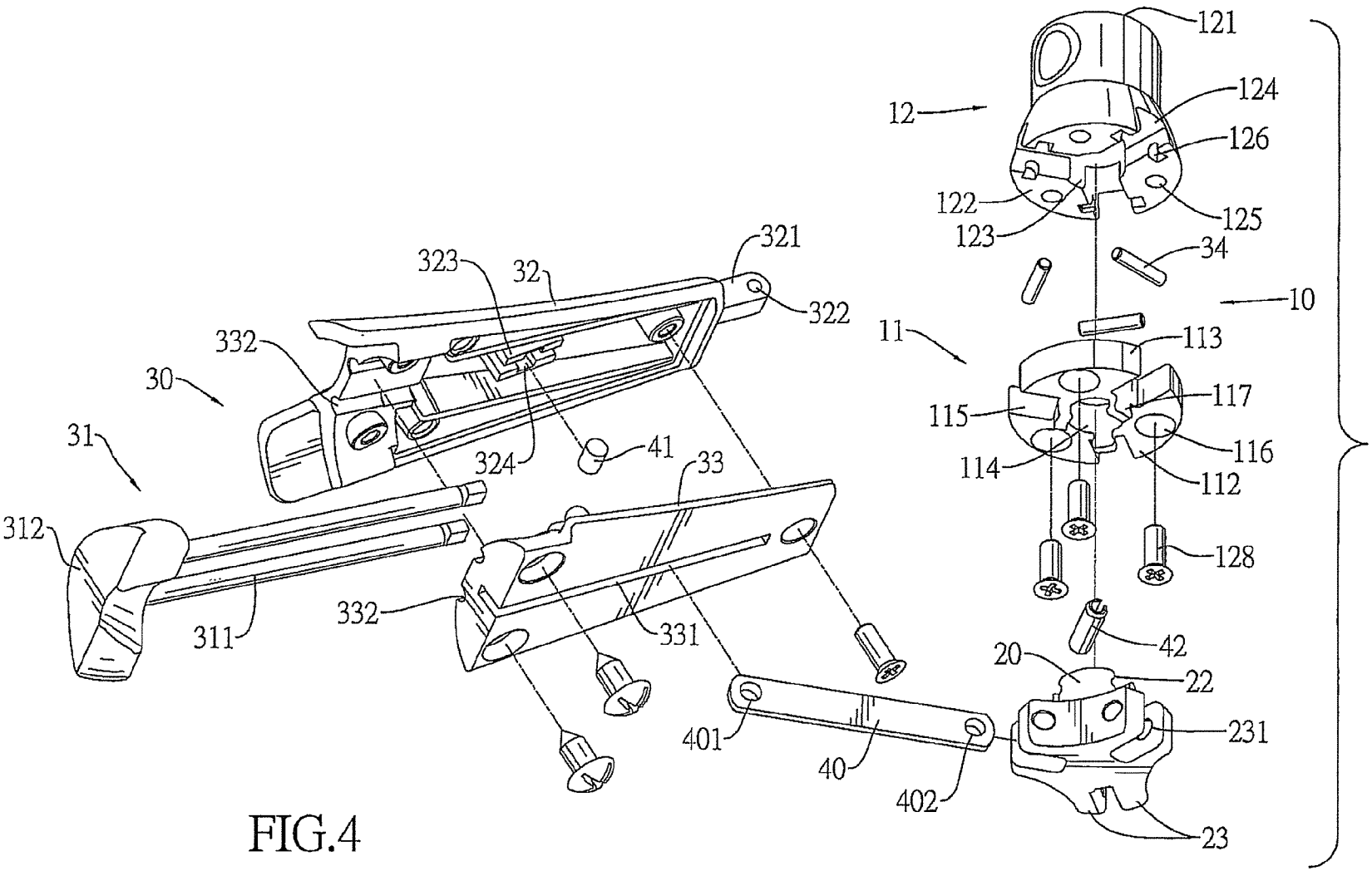
FIG. 4 is an enlarged and exploded perspective view of the upper pivot slide, the lower pivot bracket, the leg and the link of the wind instrument stand in FIG. 2.

With further reference to FIG. 4, the upper pivot slide (10) has a base (11) and a cover (12).

The base (11) has a top (111), a bottom (112), an outside surface (113), a central hole (114), multiple gaps (115), multiple mounting holes (116) and multiple fastening tabs (117). The central hole (114) is defined axially through the base (11) from the top (111) to the bottom (112). The gaps (115) are defined radially in the outside surface (113) at same intervals. The mounting holes (116) are defined axially through the base (11) and may be located respectively between adjacent gaps (115). The fastening tabs (117) are formed on and protrude down from the bottom (112).

The cover (12) is mounted on the top (111) of the base (11) and has a top surface (121), a bottom surface (122), a through hole (123), multiple slots (124), multiple mounting holes (125), a cavity (127) and multiple fastening elements (128). The through hole (123) is defined axially through the cover (12). The slots (124) are defined radially in the cover (12), communicate with the bottom surface (122), are aligned respectively with the gaps (115) of the base (11) and each slot (124) has two opposite inside walls and two pin notches (126). The pin notches (126) are defined respectively in the inside walls, communicate with the bottom surface (122) and are covered by the base (11). The mounting holes (125) are defined in the bottom surface (122). The cavity (127) is defined in the top surface (121) and communicates with the through hole (123). The fastening elements (128) are mounted respectively through the mounting holes (116) of the base (11) and in the mounting holes (125) of the cover (12).

The lower pivot bracket (20) is mounted on the bottom (112) of the base (11) of the upper pivot slide (10) and has a top, a bottom and a top hole (21) and may further have multiple fastening notches (22) and multiple pairs of prongs (23). The top hole (21) is defined in the top of the lower pivot bracket (20) and has an inner surface. The fastening notches (22) are defined in the top of the lower pivot bracket (20) and are selectively engaged respectively with the fastening tabs (117) of the base (11) of the upper pivot slide (10). The pairs of the prongs (23) are formed on and protrudes radially out from the lower pivot bracket (20) and each pair has a space defined between the prongs (23). Each prong (23) has a pivot hole (231) defined through the prong (23).

The legs (30) are pivotally mounted respectively on the upper pivot slide (10) and each leg (30) has an intermediate section and may further have an upper casing (32), a lower casing (33) and a foot (31).

The upper casing (32) is longitudinal and has a connecting end (321), a distal end, an internal space, a pivot hole (322), two mounts (323), a pivot recess (324), multiple rail slots (332) and a pivot pin (34). The connecting end (321) is mounted pivotally in one of the gaps (115) of the base (11) and one of the slots (124) of the cover (12). The internal space is defined in the upper casing (32) and has an inner surface. The pivot hole (322) is defined through the connecting end (322). The mounts (323) are formed on the inner surface of the internal space at an interval. The pivot recess (324) is defined between the mounts (323). The rail slots (332) are defined in the inner surface of the internal space. The pivot pin (34) is mounted through the pivot hole (322) of the upper casing (32) and is mounted securely in the pin notches (126) of one slot (124) of the cover (12) of the upper pivot slide (10).

The lower casing (33) is mounted on the upper casing (32), covers the internal space and has an inner surface, a slit (331) and multiple rail slots (332). The slit (331) is defined longitudinally through the lower casing (33). The rail slots (332) are defined in the inner surface of the lower casing (33) and are aligned respectively with and cooperate with the rail slots (332) of the upper casing (32) to form rail holes.

The foot (31) is mounted retractably between the upper and lower casings (32, 33) and has a pad (312) and multiple bars (311). The bars (311) are mounted on the pad (312), are parallel to one another and are slidably mounted respectively in the rail holes formed from the rail slots (332) of the upper and lower casings (32, 33).

The links (40) are connected pivotally to the lower pivot bracket (20), correspond respectively to of the legs (30), are connected respectively to the intermediate sections of the legs (30) and may slidably extend respectively through the slits (331) of the lower casings (33). Each link (40) and an inside connecting end and an outside connecting end.

The inside connecting end is connected pivotally to the lower pivot bracket (20) and may be connected pivotally in the space between one pair of the prongs (23) of the lower pivot bracket (20) and have a pivot bore (402) and a pintle (42). The pivot bore (402) is defined through the inside connecting end. The pintle (42) is mounted through the pivot bore (402) and is mounted in the pivot holes (231) of one pair of the prongs (23).

The outside connecting end is connected pivotally to the intermediate section of a corresponding leg (30). The outside connecting end may extend in the internal space of the corresponding leg (30), be connected pivotally in the interval of the mounts (323) of the corresponding leg (30) and have a pivot aperture (401) and a pintle (41). The pivot aperture (401) is defined through the outside connecting end. The pintle (41) is mounted through the pivot aperture (401) and is mounted in the pivot recess (324) between the mounts (323) of the corresponding leg (30).

The post assembly (50) is mounted on the upper pivot slide (10) and the lower pivot bracket (20) and has a post (51) and may further have a spring (52), a cap (53), a retractable rod (54) and a head (55).

The post (51) is mounted slidably through the through hole (123) of the cover (12) and the central hole (114) of the base (11) of the upper pivot slide (10), is mounted securely in the top hole (21) of the lower pivot bracket (20) and has a top end, a bottom end, a central hole (511), a lower hole (512), an upper hole (514) and a locking pin (513). The central hole (511) is defined axially through the post (51). The lower hole (512) is defined transversely in the post (51) near the bottom end. The upper hole (514) is defined transversely in the post (51) near the top end. The locking pin (513) is mounted through the lower hole (512) and tightly abuts the inner surface of the top hole (21) of the lower pivot bracket (20) to securely hold the bottom end of the post (51) in the lower pivot bracket (20).

The spring (52) is mounted in the central hole (511) of the post (51).

The cap (53) is mounted securely on the top end of the post (51), is engaged selectively with the cavity (127) of the cover (12), has a central bore (531) and may further have a mounting bore (532) and a fastener (533). The central bore (531) is defined through the cap (53), communicates with the central hole (511) and has a diameter. The mounting bore (532) is defined transversely in the cap (53). The fastener (533) is mounted through the mounting bore (532) and extends in the upper hole (514) of the post (51) to securely hold the cap (53) on the top end of the post (51).

The retractable rod (54) is mounted slidably through the central bore (531) of the cap (53) in the central hole (511) of the post (51) and has a top end, a bottom end and a flange (541). The bottom end of the retractable rod (54) abuts the spring (52). The flange (541) is annular, is formed on and protrudes radially from the bottom end of the retractable rod (54), is mounted in the central hole (511) of the post (51) and has a diameter larger than that of the central bore (531) of the cap (53) to prevent the retractable rod (54) from falling out of the post (51).

The head (55) is mounted on the top end of the retractable rod (54) may extend into an opening of a wind instrument and has an outer curved surface, a bottom, an engaging recess (551) and a fastening hole (552). The engaging recess (551) is defined in the bottom of the head (55) and is engaged selectively with the cap (53) and the cover (12) by press-fitting means and has an inner surface. The fastening hole (552) is defined in the inner surface of the engaging recess (551) and securely holds the top end of the retractable rod (54).

Figure 5:
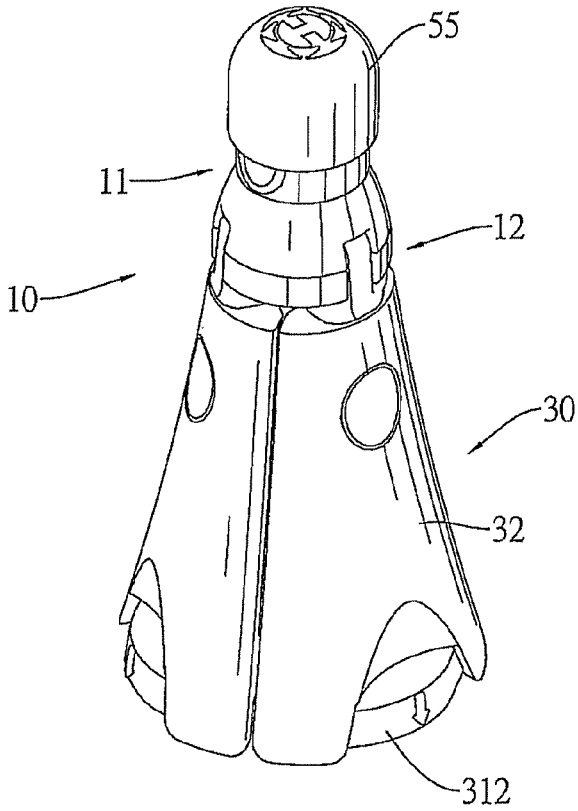
FIG. 5 is a perspective view of the wind instrument stand in FIG. 1 in a compact configuration.
Figure 6:
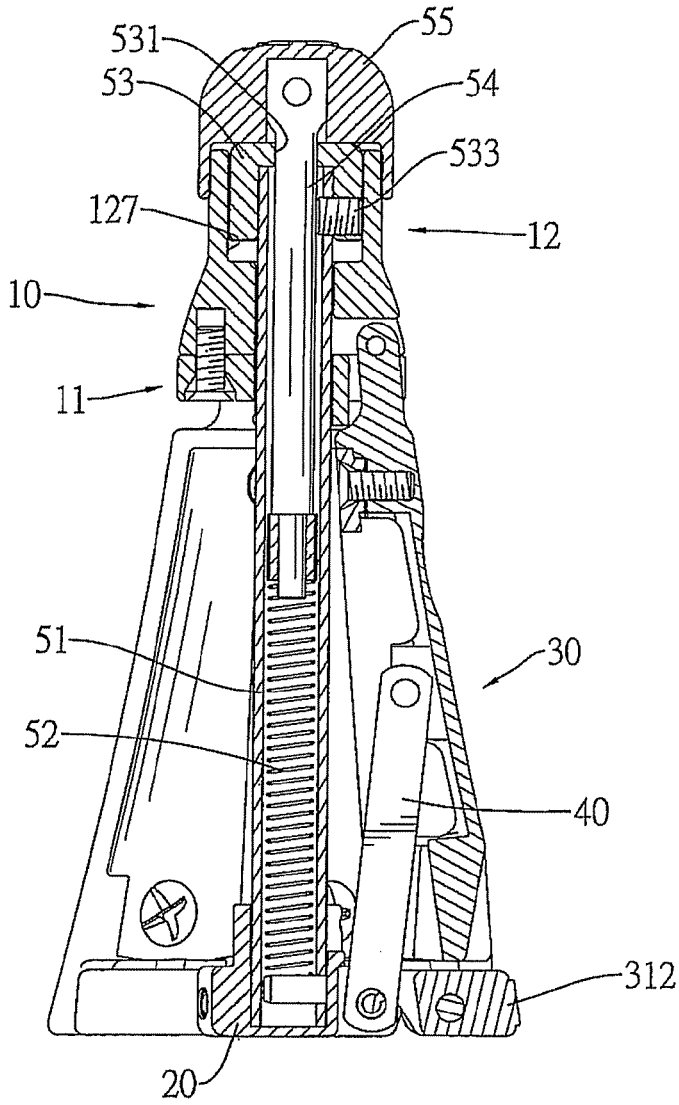
FIG. 6 is a side view in partial section of the wind instrument stand in FIG. 5.

With further reference to FIGS. 5 and 6, when the wind instrument stand is folded into a compact configuration, the lower pivot bracket (20) moves away from the upper pivot slide (10). The post (51) slides down relative to the upper pivot slide (20) till the cap (53) is engaged with the cavity (127) of the cover (12). The legs (30) and the links (40) are folded towards the post (51). The retractable (54) is retracted into the post (51) to tightly engage the engaging recess (551) of the head (55) with the cap (53). The wind instrument stand in the compact configuration may be completely inserted into the opening of the wind instrument and is carried and stored with the wind instrument into a musical instrument box.

Figure 7:
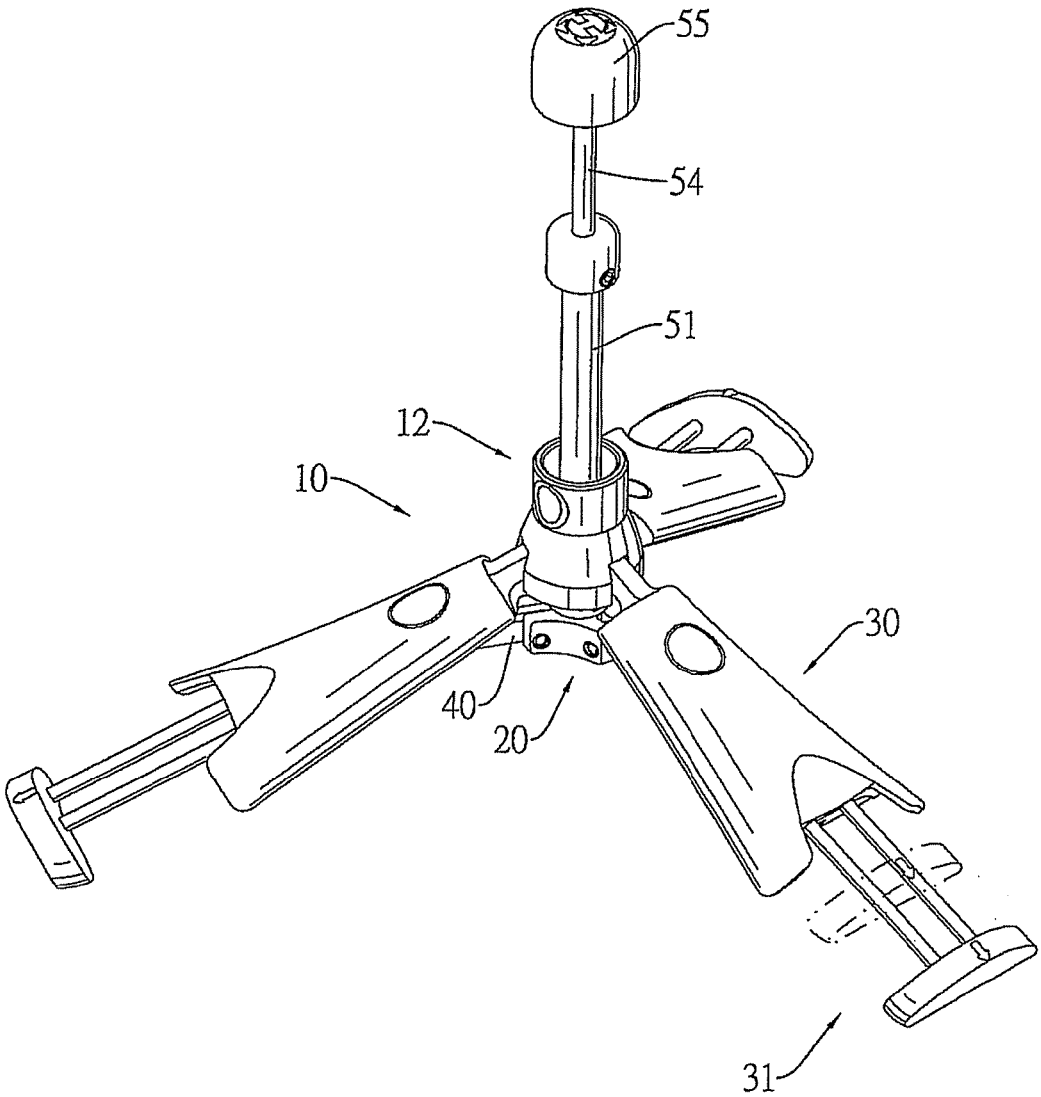
FIG. 7 is an operational perspective view of the wind instrument stand in FIG. 1 showing the foot extending out.
Figure 8:
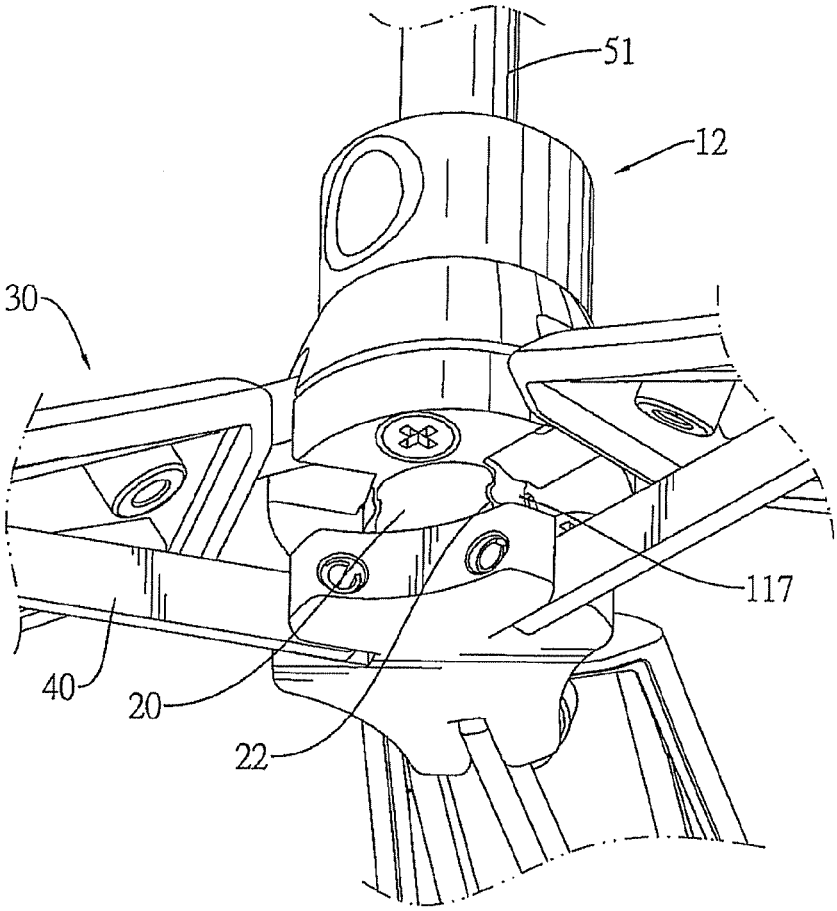
FIG. 8 is a bottom perspective view of a portion of the wind instrument stand in FIG. 1.

With further reference to FIGS. 7 and 8, when the wind instrument stand is unfolded into an expansion configuration, the head (55) is disengaged from the cap (53) and the cover (12). The post (51) slides up relative to the upper pivot slide (10). The legs (30) and links (40) are unfolded. The fastening tabs (117) of the base (11) are engaged respectively with the fastening notches (22) of the lower pivot bracket (20) to prevent the wind instrument stand from inadvertently folding. The feet (31) are extending out from the legs (30) to complete the expansion.

Because the wind instrument stand may be changed into the compact configuration, storing and carrying the wind instrument stand is easy and convenient. Furthermore, the retractable rod (54) is adjustable to change a total length of the post assembly (50) for different wind instruments.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A wind instrument stand comprising:

an upper pivot slide;

a lower pivot bracket having a top and a top hole defined in the top;

multiple legs pivotally mounted respectively on the upper pivot slide and each leg having an intermediate section;

multiple links connected pivotally to the lower pivot bracket, corresponding respectively to the legs, connected respectively to the intermediate sections of the legs and each link having an inside connecting end connected pivotally to the lower pivot bracket; and an outside connecting end connected pivotally to the intermediate section of a corresponding leg; and a post assembly has a post mounted slidably through the upper pivot slide and mounted securely in the top hole of the lower pivot bracket.

2. The wind instrument stand as claimed in claim 1, wherein the upper pivot slide has a base having a top, a bottom and an outside surface and further having a central hole defined axially through the base; and multiple gaps defined radially in the outside surface; and a cover mounted on the top of the base, having a top surface and a bottom surface and further having a through hole defined axially through the cover; and multiple slots defined radially in the cover, communicating with the bottom surface and aligned respectively with the gaps of the base; and each leg further has an upper casing having a connecting end mounted pivotally in one of the gaps of the base and one of the slots of the cover;

a distal end; and an internal space defined in the upper casing and having an inner surface; and a lower casing mounted on the upper casing and covering the internal space.

3. The wind instrument stand as claimed in claim 2, wherein the lower pivot bracket further has multiple pairs of prongs formed on and protruding radially out from the lower pivot bracket, each pair has a space defined between the prongs, and each prong has a pivot hole defined through the prong; and the inside connecting end of each link is connected pivotally in the space between one pair of the prongs of the lower pivot bracket and has a pivot bore defined through the inside connecting end; and a pintle mounted through the pivot bore and mounted in the pivot holes of one pair of the prongs.

4. The wind instrument stand as claimed in claim 3, wherein each slot of the cover has two opposite inside walls and two pin notches defined respectively in the inside walls, communicating with the bottom surface and covered by the base;

the upper casing of each leg further has a pivot hole defined through the connecting end;

two mounts formed on the inner surface of the internal space at an interval;

a pivot recess defined between the mounts; and a pivot pin mounted through the pivot hole of the upper casing and mounted securely in the pin notches of one slot of the cover of the upper pivot slide;

the lower casing of each leg has an inner surface and a slit defined longitudinally through the lower casing; and the links slidably extend respectively through the slits of the lower casings; and the outside connecting end of each link extends in the internal space of the corresponding leg, is connected pivotally in the interval of the mounts of the corresponding leg and has a pivot aperture defined through the outside connecting end; and a pintle mounted through the pivot aperture and mounted in the pivot recess between the mounts of the corresponding leg.

5. The wind instrument stand as claimed in claim 4, wherein in each leg the upper casing further has multiple rail slots defined in the inner surface of the internal space;

the lower casing further has multiple rail slots defined in the inner surface of the lower casing and aligned respectively with and cooperating with the rail slots of the upper casing to form rail holes; and a foot mounted retractably between the upper and lower casings and having a pad and multiple bars mounted on the pad, being parallel to one another and are slidably mounted respectively in the rail holes Banned from the rail slots of the upper and lower casings.

6. The wind instrument stand as claimed in claim 5, wherein in the post assembly the post is mounted slidably through the through hole of the cover and the central hole of the base and has a top end and a bottom end and further has a central hole defined axially through the post;

a lower hole defined transversely in the post near the bottom end;

an upper hole defined transversely in the post near the top end; and a locking pin mounted through the lower hole and tightly abutting the inner surface of the top hole of the lower pivot bracket;

a spring is mounted in the central hole of the post;

a cap is mounted securely on the top end of the post, is engaged selectively with a cavity in the top surface of the cover and has a central bore defined through the cap and communicating with the central hole; and a retractable rod is mounted slidably through the central bore of the cap in the central hole of the post and has a top end and a bottom end abutting the spring.

7. The wind instrument stand as claimed in claim 6, wherein the retractable rod further has a flange being annular, formed on and protruding radially from the bottom end of the retractable rod, mounted in the central hole of the post and having a diameter larger than a diameter of the central bore of the cap.

8. The wind instrument stand as claimed in claim 7, wherein the cap further has a mounting bore defined transversely in the cap; and a fastener mounted through the mounting bore and extending in the upper hole of the post.

9. The wind instrument stand as claimed in claim 8, wherein the base further has multiple fastening tabs formed on and protruding down from the bottom; and the lower pivot bracket further has multiple fastening notches defined in the top of the lower pivot bracket and selectively engaged respectively with the fastening tabs of the base of the upper pivot slide.

* * * * *